US009879834B1

(12) United States Patent
Carpenter et al.

(10) Patent No.: US 9,879,834 B1
(45) Date of Patent: Jan. 30, 2018

(54) UNIVERSAL LED LIGHT MODULE

(71) Applicants: Don David Carpenter, Urbana, OH (US); Kirk Knoblauch, Wilmington, OH (US)

(72) Inventors: Don David Carpenter, Urbana, OH (US); Kirk Knoblauch, Wilmington, OH (US)

( * ) Notice: Subject to any disclaimer, the term of this patent is extended or adjusted under 35 U.S.C. 154(b) by 257 days.

(21) Appl. No.: 14/829,752

(22) Filed: Aug. 19, 2015

Related U.S. Application Data

(60) Provisional application No. 62/155,562, filed on May 1, 2015.

(51) Int. Cl.

| | |
|---|---|
| ***F21S 9/02*** | (2006.01) |
| ***F21V 23/06*** | (2006.01) |
| ***F21V 23/02*** | (2006.01) |
| ***F21V 23/04*** | (2006.01) |
| ***F21V 15/01*** | (2006.01) |
| *F21S 9/00* | (2006.01) |
| *F21Y 101/02* | (2006.01) |

(52) U.S. Cl.
CPC ..... *F21S 9/02* (2013.01); *F21V 15/013* (2013.01); *F21V 23/02* (2013.01); *F21V 23/04* (2013.01); *F21V 23/06* (2013.01); *F21Y 2101/02* (2013.01)

(58) Field of Classification Search
CPC ..... F21S 9/02; F21V 15/013; F21V 23/02; F21V 23/04; F21V 23/06; F21K 9/235; F21K 9/275; F21K 9/278
See application file for complete search history.

(56) References Cited

U.S. PATENT DOCUMENTS

| | | | | |
|---|---|---|---|---|
| 2,817,753 | A * | 12/1957 | Corin | F21S 9/02 362/184 |
| 4,122,510 | A * | 10/1978 | Halliday, Jr. | F21L 2/00 362/189 |
| 4,417,299 | A | 11/1983 | Rupp | |
| 5,299,107 | A | 3/1994 | Ratcliffe et al. | |
| 5,303,133 | A | 4/1994 | Wagner | |
| 7,147,337 | B1 | 12/2006 | Rapisarda | |
| 7,192,156 | B1 * | 3/2007 | Hung | F21V 31/00 362/158 |
| 2010/0027085 | A1 * | 2/2010 | Catalano | F21L 14/023 359/15 |
| 2011/0096539 | A1 | 4/2011 | Sim | |

* cited by examiner

*Primary Examiner* — Anh Mai
*Assistant Examiner* — Nathaniel Lee
(74) *Attorney, Agent, or Firm* — Mark A. Navarre

(57) ABSTRACT

A universal LED light module (ULLM) that can be used in nearly any conventional or nonconventional lighting application, with module interchangeability for enabling user customization of light color and lighting function. The ULLM includes a set of axially aligned batteries with axially opposed terminals, at least one LED cell with axially opposed terminals sandwiched between two of the axially aligned batteries, and a transparent or translucent sheath radially enveloping the batteries and the LED cell to bind them together and environmentally seal them from external moisture and foreign matter. The ULLM may be activated by an external circuit or may additionally include an integral conductor that selectively bridges the exposed battery terminals. The ULLM may additionally include a lighting function element having a form factor that matches that of the batteries, and disposed in axial alignment with the batteries within the radial sheath.

12 Claims, 2 Drawing Sheets

UNIVERSAL LED LIGHT MODULE

RELATED APPLICATIONS

This application claims priority based on the Provisional Patent Application No. 62/155,562, filed May 1, 2015.

TECHNICAL FIELD

This invention relates to a universal LED light module with integral battery pack module.

BACKGROUND OF THE INVENTION

LED lamps are commonly used to selectively illuminate small or unusual objects such as toys, fishing lures, and articles of clothing. Typically, the LEDs are mounted separately from the battery pack used to power the LEDs, and wires interconnect the two to create an electrical circuit. And typically, the only component that is accessible to the user is the battery pack. Consequently, it is usually impossible or impractical to change or re-wire the LED circuit to obtain a different light color or a different lighting function (blinking vs. non-blinking, for example). Accordingly, what is desired is a universal LED light module that can be used in many different applications and that readily allows user customization.

SUMMARY OF THE INVENTION

The present invention is directed to a universal LED light module (ULLM) that can be used in nearly any conventional or nonconventional lighting application, with module interchangeability for enabling user customization of light color and lighting function. The ULLM of this invention includes a set of axially aligned battery cells with axially opposed terminals, at least one LED cell with axially opposed terminals sandwiched between two of the axially aligned battery cells, and a transparent or translucent sheath radially enveloping the battery cells and the LED cell to bind them together, environmentally seal them from external moisture and foreign matter, and prevent accidental shorting across the terminals of any battery cell or group of cells.

A shorting circuit is selectively closed to electrically bridge the battery terminals on either axial end of the ULLM for activating the LED cell; these terminals may be exposed for direct electrical connection to the shorting circuit, or may be covered by conductive end caps that seal against the radial sheath and act as terminals for the shorting circuit. The shorting circuit may be an external circuit (or liquid such as water) or an integral component of the ULLM. Optionally, the ULLM may include a lighting function element (such as a blinker circuit) having a form factor that matches that of the battery cells, and disposed in axial alignment with the battery cells within the radial sheath.

Since the ULLM is modular and self-powered, it can be easily integrated into nearly any object to produce a selective illumination function, and one ULLM may be readily exchanged with another to change the color of the produced light, to insert a module with fresh batteries, or to change the lighting function. Since the ULLM inherently emits light radially outward—that is, perpendicular to its axis—it is particularly well suited to insertion in a transparent or translucent housing, or to applications including a light pipe to transmit the emitted light to a desired spot or region.

DESCRIPTION OF THE PREFERRED EMBODIMENT

In general, the universal LED light module (ULLM) of the present invention provides a self-contained and easily interchangeable light module for emitting light to illuminate an object into which it is installed. In its most elemental form, it includes two axially aligned battery cells having axially opposed positive and negative terminals, an LED cell physically sandwiched between two of the axially aligned battery cells, and a transparent sheath radially enveloping the battery cells and the LED cell. Each of the battery cells consists of either one battery, or multiple batteries connected in series. The illustrated embodiments each include a total of three batteries connected in series through the LED cell to provide a combined driving voltage potential of approximately 5 VDC.

Figure 1A:
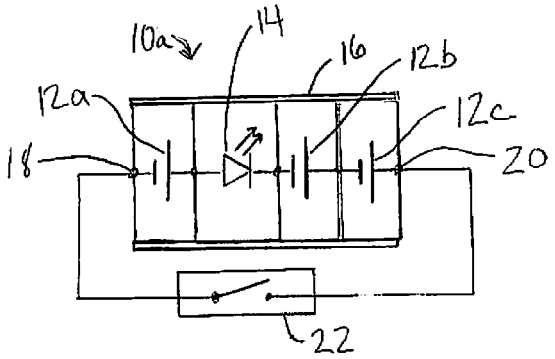
FIG. 1A is a diagram of a universal LED light module (ULLM) according to a first embodiment of this invention, with three axially aligned battery cells, a LED cell sandwiched between two of the battery cells, and an external shorting switch to selectively activate the LED cell.

In FIG. 1A, the reference numeral 10*a* generally designates a ULLM according to a first embodiment of this invention. The ULLM 10*a* includes a set of three axially aligned button-type batteries 12*a*, 12*b*, 12*c*, an LED cell 14 sandwiched between the batteries 12*a* and 12*b*, and a transparent sheath 16 radially enveloping the batteries 12*a*-12*c* and the LED cell 14. The three batteries 12*a*-12*c* are electrically connected in series (through the LED cell 14) to provide a combined voltage potential of approximately 5 VDC, though the battery 12*b* may be omitted as shown in the embodiment of FIG. 2B if desired. In any case, the LED cell 14 is oriented to be forwardly biased (and emit light) when the exposed battery cell terminals 18 and 20 at opposite axial ends of the ULLM 10*a* are electrically connected (shorted), as for example by the external shorting switch 22. The external shorting switch 22 may be a simple momentary or non-momentary switch as illustrated, or may be a more sophisticated switching circuit such as a blinker circuit, a switch that is remotely actuated by a wireless device, or a switch responsive to an external environmental condition such as pressure, temperature, gravitational orientation, liquid, humidity, etc. Also, water or another conductive fluid can perform the function of the switch 22.

The LED cell 14 may be as simple as a discrete LED having terminals electrically joined to the anode of battery 12*a* and the cathode of battery 12*b* (as depicted in the embodiments of FIGS. 2A-2B, 3 and 4A-4B), or an LED module having integral axially opposed terminals that contact the battery cell terminals. And since the most common form factor for the batteries 12*a*-12*c* is cylindrical, the LED cell 14 will most likely have a cylindrical form factor as well. Also, the LED cell 14 may include more than one LED or a lens element designed to emit light radially; or the ULLM 10*a* may include more than one LED cell 14. The radial sheath 16 may be formed of a transparent heat-shrink material, glass or an over-molded plastic; it seals against the radial peripheries of the batteries 12*a*-12*c*, leaving the negative terminal of battery 12*a* and the positive terminal of battery 12*c* exposed as indicated. The sheath 16 serves to bind the batteries 12*a*-12*c* and LED cell 14 together as a unitary module, to environmentally seal them from external moisture and foreign matter, and to prevent accidental shorting across the terminals of any battery cell or group of cells. Since the batteries 12*a*-12*b* sandwiching the LED cell 14 are optically opaque, the light produced by the LED cell 14 when activated is characteristically emitted through the sheath 16 in a radial direction—that is, perpendicular to the axis of the ULLM 10*a*. Since the most common form factor for the batteries 12*a*-12*c* is cylindrical, the ULLM 10*a* will most likely have a cylindrical form factor as well; but it will be appreciated that other non-cylindrical form factors (rectangular, for example) are also possible.

Figure 1B:
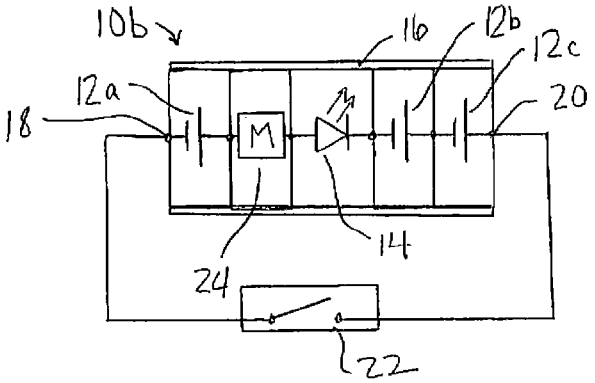
FIG. 1B is a diagram of a ULLM according to a second embodiment of this invention, additionally including an integral lighting function module.

FIG. 1B diagrammatically depicts a second embodiment of the ULLM of this invention, and is generally designated by the reference numeral 10*b*, but components common to the embodiment of FIG. 1A are designated by like reference numerals. The ULLM 10*b* differs from the ULLM 10*a* in that it includes an additional component—the lighting function module (M) 24. The lighting function module 24 has a cylindrical form factor similar that of the batteries 12*a*-12*c*, with axially opposed input and output terminals, and is connected in series with the batteries 12*a*-12*c* and LED cell 14 (either between the LED cell 14 and battery 12*a* as shown, or elsewhere in the series circuit of the module). A typical lighting function provided by the module 24 is blinking or flashing so that when the ULLM 10*b* is activated by closure of the switch 22, the LED cell 14 emits a series of pulses or bursts of light instead of a steady light. This sort of lighting function is particularly desirable in objects such as toys, apparel or fishing lures. Another possible function of the module 24 may be that of a resistor for limiting the current supplied by the battery cells 12*a*-12*c*.

Figure 2A:
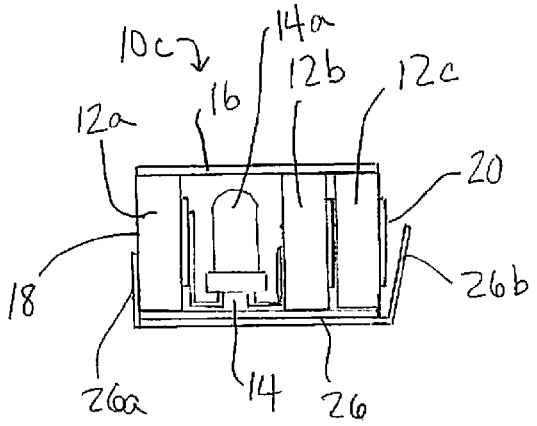
FIG. 2A depicts a ULLM according to a third embodiment of this invention, including an integral conductor that selectively bridges the exposed battery cell terminals to activate the LED cell.
Figure 2B:
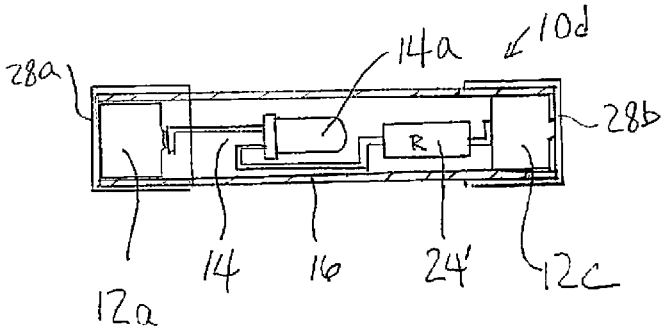
FIG. 2B depicts a ULLM according to a fourth embodiment of this invention, where the LED and battery cells are encased in a glass tube with conductive end-caps in the manner and form factor of a glass fuse.

FIG. 2A is a partial-sectional view of a ULLM according to a third embodiment this invention, and is generally designated by the reference numeral 10*c*; however, components in common with the embodiments of FIGS. 1A and 1B are designated by like reference numerals. The ULLM 10*c* differs from the ULLM 10*a* in that it includes an integral shorting conductor 26 that selectively bridges the exposed battery cell terminals 18 and 20 to activate the ULLM 10*c*. In the illustration, the shorting conductor 26 is disposed outside and adjacent to the radial sheath 16; in this case, the sheath 16 insulates the shorting conductor 26 from the cases of the batteries 12*b* and 12*c*, eliminating the need for insulation on the shorting conductor 26. But if the shorting conductor is insulated, it may be disposed next to the battery cells 12*a*-12*c* and LED cell 14, radially inside the sheath 16. A third option is to embed the shorting conductor 26 in the sheath 16, or to provide a double-layer sheath 16 with the shorting conductor 26 sandwiched between the inner and outer layers of the sheath 16. In any case, one end 26*a* of the shorting conductor 26 is fastened to the exposed terminal 18 of battery 12*a*, and the other end 26*b* is disposed adjacent to the exposed terminal 20 of battery 12*c* (though it could be the other way around). This allows the ULLM 10*c* to be activated by inward deflection of the free end 26*b* of shorting conductor 26. When the free end 26*b* contacts the exposed terminal 20 of battery cell 12*c*, it completes an electrical circuit though the batteries 12*a*-12*c* and LED cell 14 (just as with the external switch 22 of ULLMs 10*a* and 10*b*) to activate the ULLM 10*c* and light the LED cell 14. Significantly, the shorting conductor 26 is disposed opposite to the lens 14*a* of the LED cell 14 so that it does not interfere with the emission of light through the sheath 16.

FIG. 2B is a partial-sectional view of a ULLM according to a fourth embodiment this invention, and is generally designated by the reference numeral 10*d*. However, components in common with the previously described embodiments are designated by like reference numerals, including a function module 24', which in this case is a current limiting resistor R. The ULLM 10*d* is unique in that it has the appearance and form factor of a conventional automotive glass fuse with conductive end caps 28*a* and 28*b*. In this case, the radial sheath 16 is a glass tube, and the LED cell 14, the function module 24, and batteries 12*a* and 12*c* are mounted therein. The conductive end caps 28*a*, 28*b* are affixed (crimped and/or glued) on the ends of the glass sheath 16, and electrically contact the exposed battery terminals. Thus, the end cap 28*a* electrically contacts the cathode of battery 12*a*, and the end cap 28*b* electrically contacts the anode of battery 12*c*; the glass sheath 16 electrically insulates the radial peripheries of batteries 12*a* and 12*c* from the end caps 28*a*, 28*b*. This embodiment can be used with an integral shorting conductor like the embodiment of FIG. 2A, but is most effectively used with an external shorting switch 22 because it can be inserted into a transparent fuse holder or retained by a set of conventional fuse clips.

Figure 3:
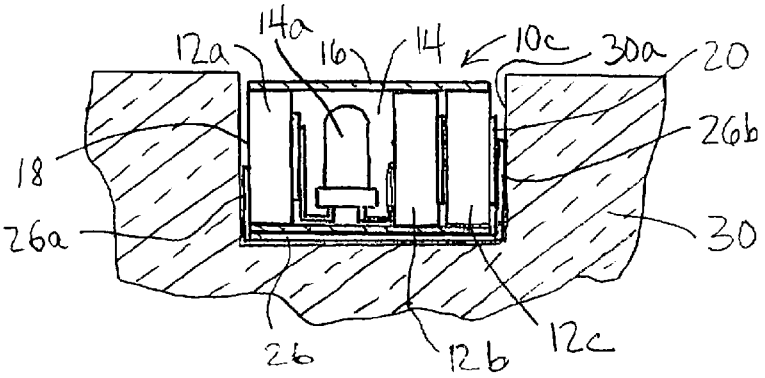
FIG. 3 depicts the ULLM of FIG. 2 installed in a transparent or translucent housing.

FIG. 3 is a partial-sectional view of the ULLM 10*c* as installed in a compartment 30*a* formed in a housing 30. Inserting the ULLM 10*c* into the compartment 30*a* inwardly deflects the free end 26*b* of the shorting conductor 26 to activate the ULLM 10*c*, as well as to mechanically retain the ULLM 10*c* within the compartment 30*a*. Additionally, the compartment 30*a* may include an integral spring at one end (in the manner of a conventional battery compartment) to firmly seat the ULLM 10*c* in the compartment 30*a*. In the illustration, the LED cell 14 has a single LED element, and its lens 14*a* is pointed toward the opening of the compartment 30*a* so that the emitted light is primarily directed away from the housing 30. However, a significant portion of the light is emitted toward the sides and bottom of the compartment 30*a*; for this light to be usefully employed, the housing 30 may be constructed of a light-transmissive (i.e., transparent or translucent) material, or alternately, the housing compartment 30*a* may be lined with a light-reflective coating. If the objective is to transmit the emitted light primarily through the light-transmissive housing 30, the ULLM 10*c* can be oriented so to that the lens 14*a* of LED cell 14 is pointed away from the opening of the compartment 30*a* so that the emitted light is primarily directed into and through the housing 30. Optionally, the compartment 30*a* may be closed with a lid, but this is not necessary since the components of ULLM 10*c* are sealed by the radial sheath 16. Also, the housing 30 may be a conventional battery compartment designed to hold a Double-A battery, for example.

Figure 4A:
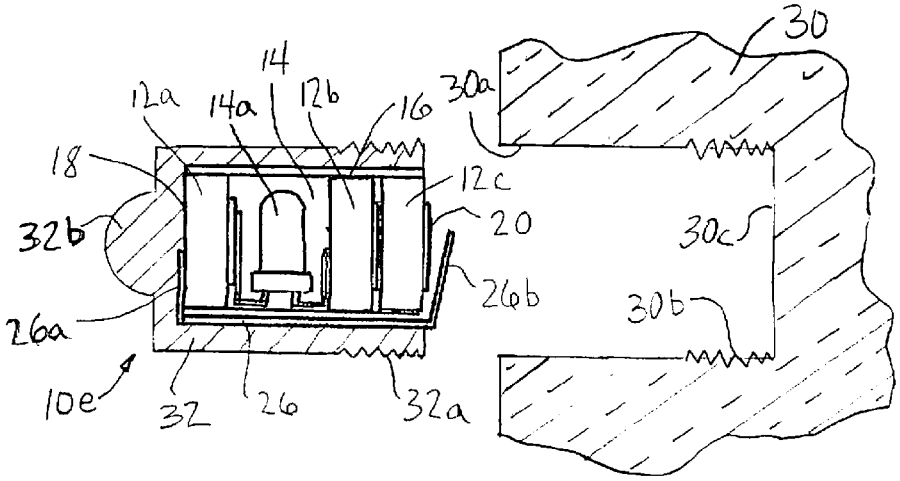
FIG. 4A depicts a ULLM according to a fifth embodiment of this invention, like the ULLM of the third embodiment, but additionally including a transparent or translucent outer shell with external threads for installation in a threaded housing compartment.
Figure 4B:
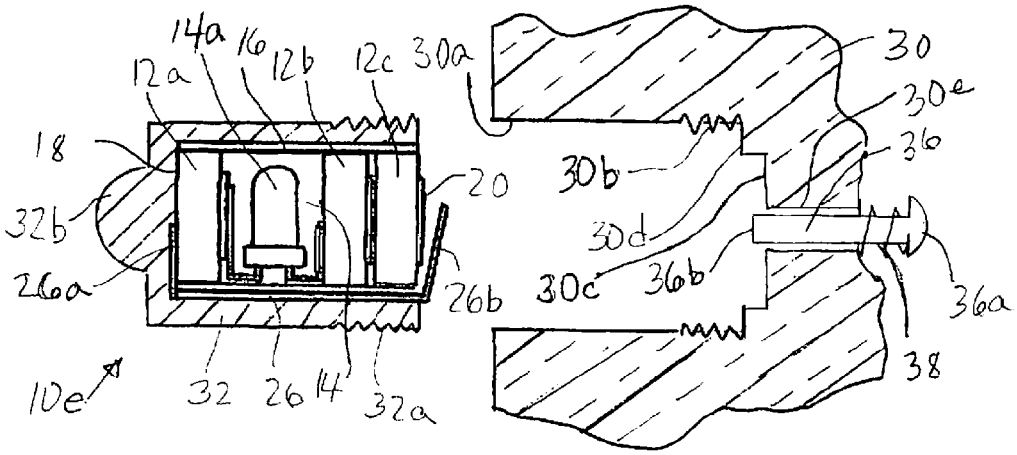
FIG. 4B depicts the ULLM of FIG. 4A and a housing including a plunger for activating the ULLM when installed in the housing.

FIGS. 4A and 4B depict partial-sectional views of a ULLM 10*e* according to a fourth embodiment this invention; and components in common with the previously described embodiments are designated by like reference numerals. The ULLM 10*e* differs from the ULLM 10*c* in that it includes an outer light-transmissive shell 32 that envelopes all but the exposed terminal 20 of battery 12*c* and the free end 26*b* of shorting conductor 26. Further, the open end 32*a* of the shell 30 is formed with screw threads on its outer periphery, and the opposite (i.e., closed) end of shell 30 is provided with an axially protruding tab 32*b* which can be grasped by a person installing or removing the ULLM 10*e* from the housing 30. In this case, the housing compartment 30*a* is configured to receive the ULLM 10*e* axially instead of radially (i.e., the compartment 30*a* is deep and narrow, instead of shallow and wide), and the inner periphery of compartment 30*a* is provided with screw threads 30*b* at its bottom so that the ULLM 10*e* can be inserted into the compartment 30*a* and secured therein by rotating it to couple the screw threads 32*a* of ULLM 10*e* with the screw threads 30*b*.

In the embodiment of FIG. 4A, the screw threads 30*b* of housing compartment 30*a* terminate at the bottom 30*c* of the compartment. When the ULLM 10*e* is inserted into the compartment 30*a* and rotated to engage the threads 32*a* and 30*b*, the bottom surface 30*c* of the compartment 30*a* eventually contacts the free end 26*b* of shorting conductor 26 and deflects it inward to contact the exposed terminal 20 of battery 12*c* to activate the ULLM 10*e*. Nearly all of the light produced by the LED cell 14 when ULLM 10*e* is activated is directed radially outward, through the light-transmissive shell 32, and into the light-transmissive housing 30. When it is desired to de-activate the ULLM 10*e*, the user can reverse-rotate the ULLM 10*e* in compartment 30*a* using the integral tab 32*b* until the distance of the ULLM 10*e* from the bottom 30*c* of compartment 30*a* is sufficient to allow the free end 26*b* of shorting conductor 26 to disengage from the exposed terminal 20 of battery 12*c*. This allows the ULLM 10*e* to be securely retained within the compartment 30*a* of housing 30 whether the ULLM 10*e* is activated or deactivated.

The embodiment of FIG. 4B differs from the embodiment of FIG. 4A in that the housing compartment 30*a* incorporates an internal shoulder 30*d*, and a central plunger 36 extending though an axial opening 30*e* formed in the bottom 30*c* of the compartment 30*a*. When the ULLM 10*e* is inserted into the compartment 30*a* and rotated to engage the screw threads 32*a* and 30*b*, the open end of the light transmissive shell 32 contacts the internal shoulder 30*d* of compartment 30*a*, thereby limiting inward travel of the ULLM 10*e* before the free end 26*b* of shorting conductor 26 contacts the bottom 30*c* of the compartment 30*a*. A spring 38 biases the plunger 36 away from the ULLM 10*e*, but force applied to the head 36*a* of plunger 36 compresses the spring 38 and brings the plunger's inboard end 36*b* into contact with the free end 26*b* of shorting conductor 26, deflecting it against the exposed terminal 20 of battery 12*c* to activate the ULLM 10*e*. Thus in this embodiment, the ULLM 10*e* is activated only when the plunger 36 is translated in a direction to compress spring 38.

It will thus be appreciated that the ULLMs of the present invention may be used in a myriad of conventional and non-conventional lighting applications, including applications in which the ULLM may be exposed to moisture and/or foreign matter. Since the ULLM includes its own power supply, all that is required is a clip or some other means of securing the ULLM, or a compartment into which the ULLM is installed. And the user can easily exchange one ULLM for another to obtain a different color light or a different lighting function. While the ULLM of the present invention has been described with respect to the illustrated embodiments, it is recognized that numerous modifications and variations in addition to those mentioned herein will occur to those skilled in the art. Accordingly, it is intended that the invention not be limited to the disclosed embodiments, but that it have the full scope permitted by the language of the following claims.

The invention claimed is:

1. A universal LED light module comprising:

a LED cell having first and second axially opposed terminals;

first and second battery cells disposed in axial alignment with said LED cell and at opposite axial ends thereof, the first battery cell having an anode terminal that contacts the first terminal of the LED cell, and the second battery cell having a cathode terminal that contacts the second terminal of the LED cell;

a light transmissive tubular sheath radially enveloping said LED cell and said first and second battery cells to bind such cells together and seal them from external moisture and foreign matter; and a shorting circuit that contacts a cathode of said first battery cell and an anode of said second battery cell to selectively complete a series circuit including said shorting circuit, said LED cell and said first and second battery cells.

2. The universal LED light module of claim 1, further comprising:

a light function module disposed within said tubular sheath and electrically connected in said series circuit.

3. The universal LED light module of claim 1, where said cathode of said first battery cell and said anode of said second battery cell are exposed for electrical connection thereto.

4. The universal LED light module of claim 1, further comprising:

first and second conductive end caps affixed on axially opposed ends of said tubular sheath, where said first conductive end cap is electrically coupled to contacts said cathode of said first battery cell, and said second conductive end cap contacts said anode of said second battery cell, said shorting circuit contacting said first and second conductive end caps.

5. The universal LED light module of claim 1, where:

said shorting circuit includes a shorting conductor having a first end that contacts one of said cathode of said first battery cell and anode of said second battery cell, and a second end disposed adjacent to the other of said cathode of said first battery cell and anode of said second battery cell, said second end being deflectable to contact the other of said cathode of said first battery cell and anode of said second battery cell to complete said series circuit.

6. The universal LED light module of claim 5, where a portion of said shorting conductor intermediate said first and second ends is disposed within said tubular sheath.

7. The universal LED light module of claim 5, where a portion of said shorting conductor intermediate said first and second ends is disposed radially outside said tubular sheath.

8. The universal LED light module of claim 5, further comprising:

a light transmissive shell that encases all but one of said cathode of said first battery cell and anode of said second battery cell, said light transmissive shell having an outer periphery on which are formed screw threads for removably installing said universal LED light module in a compartment having internal screw threads.

9. The universal LED light module of claim 8, where:

a surface or component of said compartment deflects the second end of said shorting conductor to complete said series circuit when said universal LED light module is installed in said compartment.

10. The universal LED light module of claim 8, where:

said light transmissive shell includes an integral axially protruding tab for installing and removing said universal LED light module.

11. A universal LED light module comprising:

at least first and second axially aligned batteries having axially opposed positive and negative terminals;

a LED cell having first and second axially opposed terminals, said LED cell being sandwiched between two of said axially aligned batteries with the first terminal of the LED cell contacting a positive terminal of the first battery, and the second terminal of the LED cell contacting a negative terminal of the second battery;

a light transmissive tubular sheath radially enveloping said LED cell and said axially aligned batteries to bind them together and seal them from external moisture and foreign matter; and a shorting circuit that contacts exposed axial terminals of said axially aligned batteries to selectively complete a series circuit including said LED cell and said axially aligned batteries.

12. The universal LED light module of claim 11, where:

said shorting circuit includes an environmentally responsive switch.

* * * * *